United States Patent [19]

Grenadier

[11] 4,128,239

[45] Dec. 5, 1978

[54] SOLID MOLDED PADDLE CONSTRUCTION

[76] Inventor: Lewis Grenadier, 19 Lancaster Ct., Cresskill, N.J. 07626

[21] Appl. No.: 737,002

[22] Filed: Oct. 29, 1976

[51] Int. Cl.[2] ..... A63B 59/00

[52] U.S. Cl. ..... 273/67 R

[58] Field of Search ..... 273/67 R, 73 R, 73 C, 273/73 J, 75, 76

[56] References Cited

U.S. PATENT DOCUMENTS

| | | | |
|---|---|---|---|
| D. 192,740 | 5/1962 | Ziabicki | 273/73 R X |
| D. 237,990 | 12/1975 | Gillespie et al. | 273/73 C X |
| 1,961,473 | 6/1934 | Baltzley | 273/76 |
| 3,582,072 | 6/1971 | Stueck | 273/73 C X |
| 3,879,035 | 4/1975 | Danchulis et al. | 273/73 C |
| 3,934,876 | 1/1976 | Haddad | 273/73 C |
| 4,062,541 | 12/1977 | Marks | 273/73 R X |

FOREIGN PATENT DOCUMENTS

| | | | |
|---|---|---|---|
| 758899 | 11/1933 | France | 273/76 |
| 802060 | 5/1936 | France | 273/76 |
| 995102 | 8/1951 | France | 273/67 R |
| 607255 | 8/1948 | United Kingdom | 273/76 |

OTHER PUBLICATIONS

"The Sporting Goods Dealer"; Jul. 1976; p. 131.

*Primary Examiner*—Richard J. Apley
*Attorney, Agent, or Firm*—McAulay, Fields, Fisher & Goldstein

[57] ABSTRACT

A solid molded paddle construction for striking a ball during play in a ball game comprising a face portion having a unitary face member and a peripheral edge portion. A handle extension is integral with the face portion and provides a grip for the user. The face portion is provided with a plurality of openings, the spacing of which is smaller than the diameter of the ball. Accordingly, when the ball is struck, it deforms and the openings bite into the ball to permit the player to develop spin on the ball. Preferably, the paddle is molded by an aluminum die-casting process.

6 Claims, 5 Drawing Figures

SOLID MOLDED PADDLE CONSTRUCTION

The present invention relates generally to a paddle construction for use in a ball game and, more particularly, pertains to a solid molded paddle construction that provides consistently good performance.

So-called paddle ball games are gaining increasing popularity among the ball playing public. Most of the paddles used in these games are fabricated from wood and suffer from a number of drawbacks. For example, many types of wooden paddles warp after relatively short use thereby rendering them unsuitable for continued play. In order to eliminate this problem, many paddles are constructed of plies in which the direction of grain alternates. However, this produces a heavy and costly paddle. Obviously, heavy paddles quickly tire a player's arm and therefore are equally unsuitable.

Other disadvantages associated with wooden paddles include peeling or splintering of the outermost ply, thereby producing a non-planar surface which, when striking the ball, deflects the ball at an unintentional angle. Additionally, rough handling, which is normal in most games, will cause the paddles to crack.

Accordingly, an object of the present invention is to provide an improved paddle construction.

A more specific object of the present invention is to provide a relatively strong and flexible paddle construction that will withstand rough handling and usage.

A further object of the present invention is to provide paddle constructions having substantially indentical properties thereby eliminating variations in properties from paddle to paddle.

Another object of the present invention resides in the novel details of construction that provides a paddle of the type described that is molded as a solid unitary construction.

Accordingly, a solid molded paddle construction constructed according to the present invention comprises a face portion and an integral handle extension. The face portion comprises a unitary face member and a peripheral edge portion. A plurality of openings extend through the face member and a handle is connected to the handle extension. Thus, the solid molded paddle construction cannot warp or crack and, for that matter, is substantially indestructible.

Other features and advantages of the present invention will become apparent from a consideration of the following detailed description, when taken in conjunction with the accompanying drawings in which.

As noted hereinabove, most paddles utilized in paddle-type ball games are fabricated from wood and suffer from a number of disadvantages, many of which have been specified above. On the other hand, the present invention is directed to a solid molded paddle construction that, for all intents and purposes, eliminates the problems heretofore experienced by players using wooden paddles. That is, the solid molded paddle constructions of the present invention are strong yet flexible. Moreover, they are lightweight and do not tire the arm of the player. Because of the increased strength of the paddles of the present invention, more openings in the paddle face may be provided per unit area as compared with wooden paddles. As noted hereinbelow, this feature permits the player to develop a great amount of spin on the ball.

Figure 1:
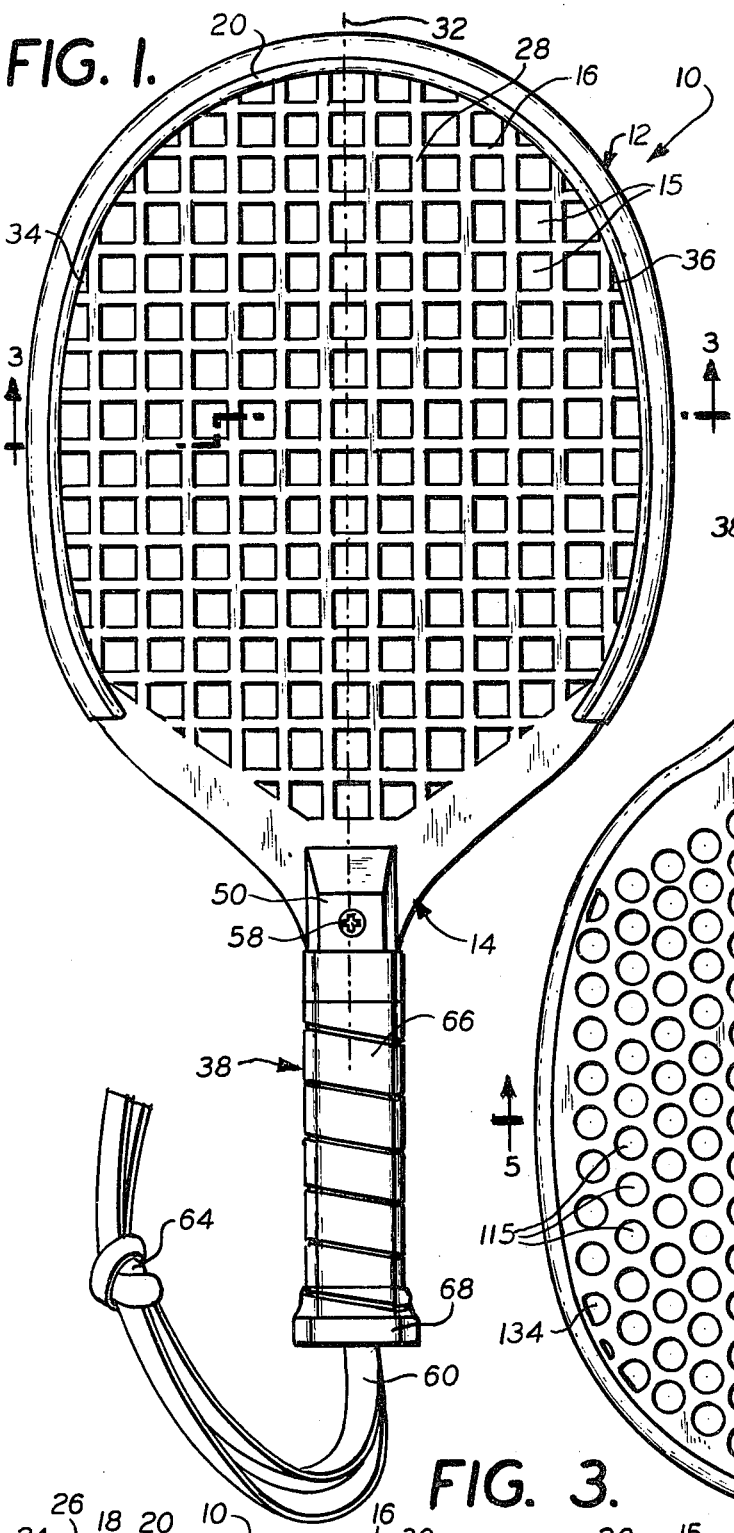
FIG. 1 is a front elevational view of a paddle constructed according to the present invention.
Figure 3:
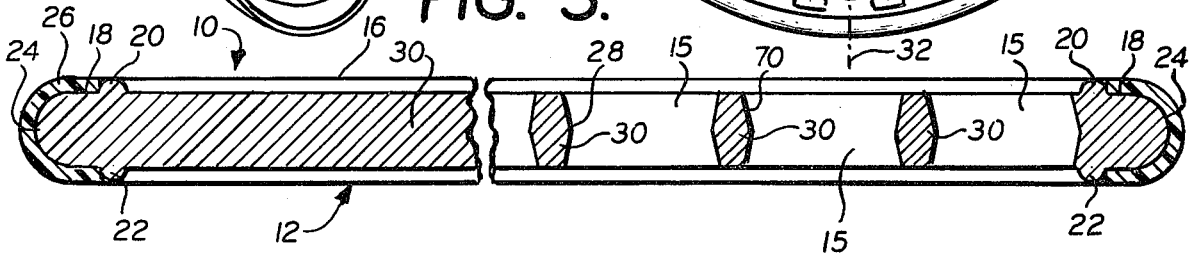
FIG. 3 is a sectional view, with parts broken away, taken along the line 3—3 of FIG. 1.
Figure 2:
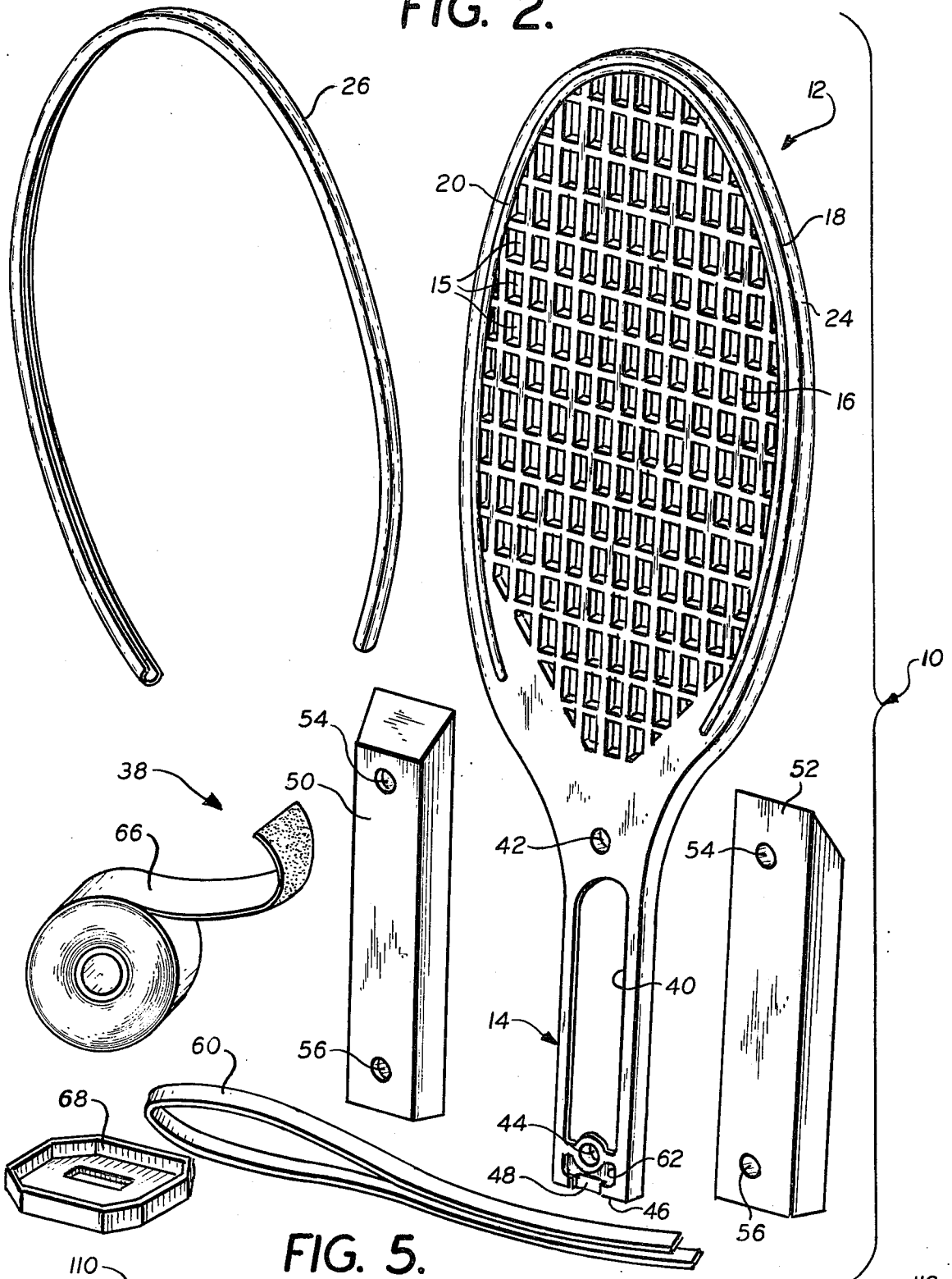
FIG. 2 is a perspective exploded view of the paddle construction shown in FIG. 1.

More specifically, a paddle constructed according to the present invention is designated generally by the reference character 10 in FIGS. 1–3 and comprises a face portion 12 and an integral handle extension 14. The portion 12 and extension 14 are molded from a metal, as noted in detail below, to form a single unitary solid member. The face portion 12 includes a face member 16 and an integral peripheral edge 18 (FIGS. 2 and 3). The peripheral edge 18 is defined by raised beads 20 and 22 on the respective faces of the paddle. The end of the edge 18 is rounded at 24 and receives a plastic sleeve 26 thereon. The sleeve may be fabricated from vinyl or the like and is affixed to the paddle by either snapping the sleeve into place or by gluing the sleeve into place with a suitable adhesive. The sleeve surrounds the peripheral edge of the paddle and substantially blends in with the portion of the face of the paddle immediately adjacent the sleeve so as to present a substantially continuous surface thereat and serves to protect the edge of the paddle from scrapes, scratching, etc.

The face member 16 is provided with a plurality of square openings 15 which are formed by a grid structure 28 molded integrally with the edge 18. That is, as shown in FIG. 3, the grid structure 28 comprises solid ribs 30 that extend in both the vertical and horizontal direction across the face portion 16. The openings 15 are symmetrically located with respect to a vertical center line 32. That is, adjacent the edge 18, only portions of the square are formed such as square portion 34 adjacent the left-hand edge as taken in FIG. 1. However, symmetrically located adjacent the right-hand edge of the face portion is square portion 36. On the other hand, as shown in the Figs., the throat portion of the racket is solid to provide added strength at this critical point.

The paddle construction thus far described produces new and unobvious results. That is, because of the strength provided by the solid molded paddle construction, the openings 15 may be placed very close to each other. Thus, when a ball is struck by the paddle 10, the ball deforms and to some extent enters the openings 15. The edges of the openings "bite" into the ball and permit the player to apply spin to the ball. It is obvious that the greater the amount of bite, the greater will be the amount of spin that may be applied to the ball. Thus, by placing the openings 15 relatively close together as in the present invention, the player is able to obtain much greater control over the ball. Additionally, and as an added feature, the provision of more holes in the racket face decreases the amount of air resistance thereby permitting the player to freely swing at the ball during play.

In an actual construction, an aluminum alloy having a hardness of T 6 was utilized. The thickness of the aluminum was 0.250 inches and the squares were 0.5 inches wide and spaced 0.625 inches on center. The total weight of the racket (including the handle described below) varied between 15 ¾ ounces and 17 ounces. The center of gravity was located 7 13/16 inches from the top of the racket. While the invention contemplates any suitable molding technique for making the paddle, aluminum die-casting has been found to be most advantageous.

In order to provide a firm grip for the player, a handle 38 is connected to the handle extension 14. To be more specific, the handle extension 14 includes a symmetrically located elongated opening 40 to reduce paddle weight. Bores 42 and 44 are provided to receive holding screws while the bottom edge 46 of the handle extension is provided with a recess 48 which receives a wrist loop as noted below.

The handle includes sections 50 and 52 which are received on each side of the handle extension 14. The sections are provided with upper bores 54 and lower bores 56 which are adapted to be respectively aligned with bores 42 and 44 in the handle extension. Appropriate screws such as screw 58 (FIG. 1) extend through the bores 54 and 42 and through the bores 56 and 44 and receive a nut or the like on the other end to firmly clamp the sections 50 and 52 to the handle extension 14. The sections 50 and 52 are faceted to provide a multi-faceted handle which facilitates gripping the paddle.

Prior to assembling the sections 50 and 52 to the handle extension 14, a wrist strap 60 is extended through a slot 62 in the handle extension. The ends of the wrist strap 60 are received in the recess 48 and the wrist strap is knotted at 64 so the paddle may be connected to the wrist of the player by slipping the hand through the loop formed thereby. A tape 66, which may be formed of leather or a suitable plastic, is wrapped around the sections 50 and 52 in the conventional manner. A cap 68 is secured to the bottom of the handle as by an adhesive or similar means to prevent the tape from unraveling.

Accordingly, a solid molded paddle construction has been described which is superior in all respects to paddles presently available and which permits the player to accurately control a ball during play.

Figure 4:
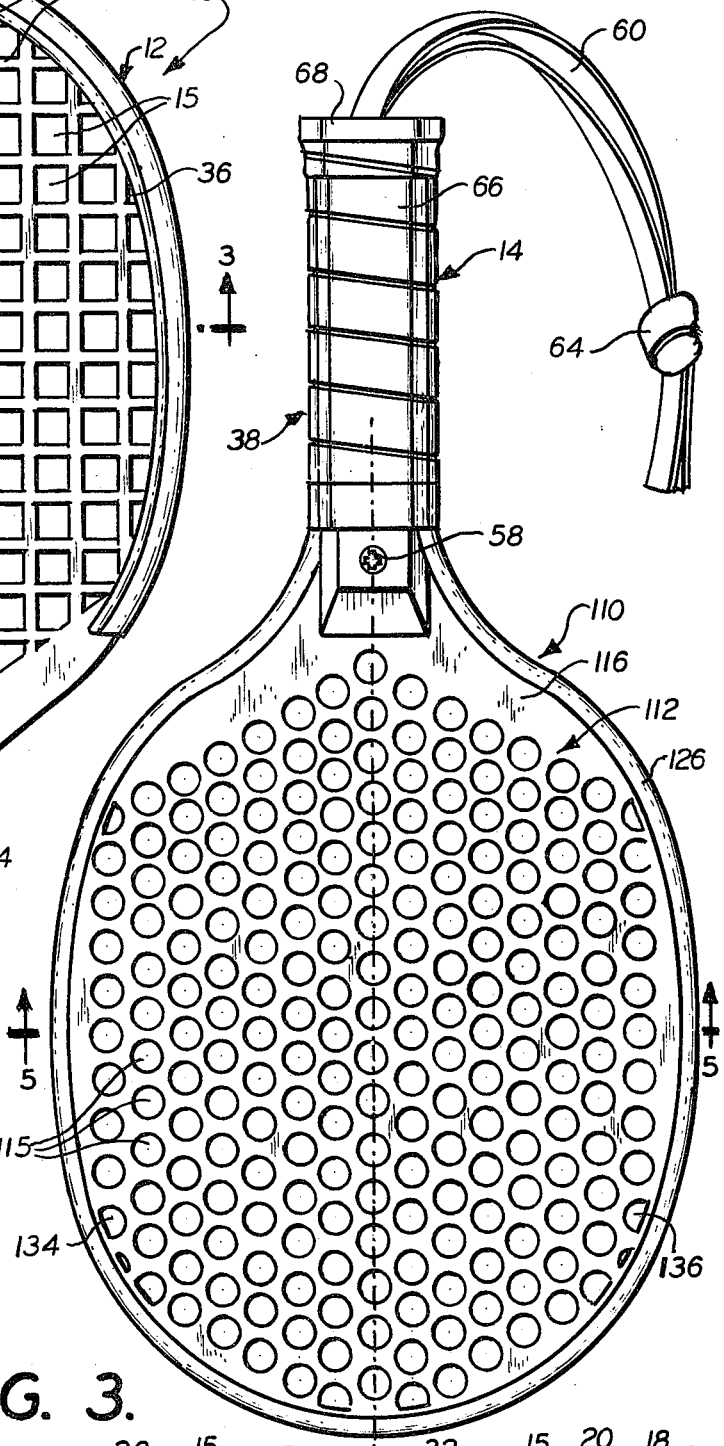
FIG. 4 is a front elevational view of a modified embodiment of a paddle constructed according to the present invention.
Figure 5:
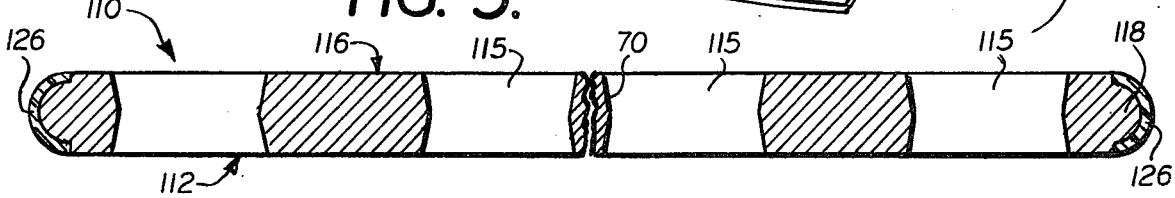
FIG. 5 is a sectional view, with parts broken away, taken along the line 5—5 of FIG. 4.

FIGS. 4 and 5 illustrate a modified embodiment of a paddle constructed according to the present invention. Similar reference characters in the figures indicate identical elements. Accordingly, the paddle construction 110 of FIGS. 4 and 5 comprises a face portion 112 and an integral handle extension 14. A handle 38 is connected to the handle extension 14 and is identical to the handle construction 38 of the embodiment of FIGS. 1–3. The face portion 112 includes a face member 116 having a recessed peripheral edge portion 118. A plastic sleeve 126, fabricated from vinyl or the like, is received about the peripheral edge 118. That is, as shown in FIG. 5, the sleeve fills the recess to substantially blend in with the portion of the face immediately adjacent to said sleeve so as to present a substantially continuous surface thereat.

A plurality of openings 115 are provided in the face portion 116 and are symmetrical about the center line 32. The openings 115 are circular in cross-section and extend through the entire face portion of the racket. Similarly to the embodiment of FIGS. 1–3, a portion of the opening such as circular portion 134 on one side of the center line 32 is symmetrical with respect to a portion of an opening such as 136 on the other side of the center line 32.

Similarly to the paddle construction 10, the openings 115 in the paddle construction 110 are spaced very close together so that a great number of edges defining the openings 110 will bite into a ball when the ball is struck by the racket. In an actual construction, the racket 110 was fabricated from the same material as the racket 10. However, the openings 115 had a diameter of 0.500 inches (which is substantially smaller than the diameter of the ball to be used with the paddle) and a spacing of 0.594 inches on center. Thus, the paddle 110 likewise gives the player increased control over the ball.

As shown in both FIGS. 3 and 5, the openings 15 and 115 are provided with a draft 70 so that the respective paddle may be easily removed from the molds after the molding process.

While preferred embodiments of the invention have been shown and described herein it will become obvious that numerous omissions, changes and additions may be made in such embodiments without departing from the spirit and scope of the present invention.

What is claimed is:

1. A solid molded metal paddle construction comprising a face portion for striking a ball and handle means for gripping said paddle, said face portion comprising a unitary face member having a recessed peripheral edge portion, a plastic sleeve gripping said peripheral edge portion and filling said recess to substantially blend in with the portion of said face immediately adjacent said sleeve so as to present a substantially continuous surface thereat, a plurality of openings extending through said face member, said handle means comprising a handle extension, a solid throat portion between said face portion and said handle extension, said throat portion, face portion and handle extension being of unitary construction, said plurality of openings being symmetrical about a vertical center line, the spacing between said openings being substantially smaller than the diameter of a ball adapted to be hit by said paddle, whereby the ball covers a preselected number of said plurality of openings when it is struck by said paddle, said handle extension comprising an elongated member, a through slot in said extension extending substantially the length of said extension and terminating above the bottom edge thereof, and a grip connected to said handle extension, said grip comprising a first section on one side of said extension and a second section on the other side of said extension, means for connecting together said extension and said sections, said first and second sections being multi-faceted to provide a multi-faceted grip, said first and second sections having a flat face in contact with said handle extension so as to leave said slot open, and tape means surrounding said first and second sections to increase the friction between said paddle construction and the hand of a player.

2. A solid molded paddle construction as in claim 1, in which said plurality of openings are circular and symmetrically located about a vertical center line, the diameter of said openings being substantially less than the diameter of the ball, whereby said ball extends across a number of said circular openings when said ball is struck by said paddle.

3. A solid molded paddle construction as in claim 1, in which said plurality of openings comprise squares, said squares being formed by a grid integral with said peripheral edge.

4. A solid molded paddle construction as in claim 3, in which said squares are spaced 0.625 inches on center.

5. A solid molded paddle construction as in claim 4, in which said paddle is fabricated from aluminum having a thickness of one-quarter inch and a hardness of T 6.

6. A solid molded paddle construction as in claim 1, and a strap connected to said handle means.

* * * * *